United States Patent [19]

Ikeda et al.

[11] Patent Number: 4,548,660

[45] Date of Patent: Oct. 22, 1985

[54] WATER-IN-OIL EMULSION EXPLOSIVE

[75] Inventors: Yoshiyuki Ikeda; Atsuo Inoue; Kenjiro Ikeda, all of Yamaguchi, Japan

[73] Assignee: Nippon Kayaku Kabushiki Kaisha, Tokyo, Japan

[21] Appl. No.: 579,957

[22] Filed: Feb. 14, 1984

[30] Foreign Application Priority Data

Feb. 24, 1983 [JP] Japan ..... 58-28521

[51] Int. Cl.[4] ..... C06B 45/02

[52] U.S. Cl. ..... 149/21; 149/2; 149/45; 149/46; 149/47; 149/61; 149/62; 149/76; 149/77; 149/78; 149/83; 149/92

[58] Field of Search ..... 149/2, 21, 46, 47, 61, 149/62, 45, 76, 77, 78, 83, 92

[56] References Cited

U.S. PATENT DOCUMENTS 4,391,659 7/1983 Smith ..... 149/2 X
4,470,855 9/1984 Bampfield ..... 149/2

FOREIGN PATENT DOCUMENTS 149893 9/1982 Japan .

*Primary Examiner*—Stephen J. Lechert, Jr.
*Attorney, Agent, or Firm*—Oblon, Fisher, Spivak, McClelland & Maier

[57] ABSTRACT

Disclosed herein is an explosive of a water-in-oil emulsion type including an aqueous oxidizer solution, an oily material, an emulsifier and hollow microspheres, wherein the oily material forming the continuous phase of the emulsion comprises an oil component and at least one polymer selected from the group consisting of epoxy resin, unsaturated polyester resin, polybutene, polyisobutylene, petroleum resin, butadiene resin and ethylene vinyl acetate copolymer.

7 Claims, No Drawings

WATER-IN-OIL EMULSION EXPLOSIVE

BACKGROUND OF THE INVENTION

The present invention relates to a water-in-oil type (hereinafter referred to as w/o type) emulsion explosive.

Since the first disclosure of a w/o type emulsion explosive in U.S. Pat. No. 3,161,551, the improvement thereof has been carried out and disclosed in U.S. Pat. Nos. 3,242,019; 3,447,978; 3,715,247; 3,770,522; 4,008,108 and 4,110,134. The w/o type emulsion explosives disclosed in the above-mentioned U.S. Patents are the explosives which contain fundamentally as the continuous phase thereof (oil component) such as a hydrophobic carbonaceous fuel, mineral oils, waxes and the like, as the discontinuous phase thereof, an aqeuous solution of an oxidant mainly composed of ammonium nitrate, and as an emulsifier, w/o type emulsifier, and by adding a sensitizer such as nitric acid, strontium ions, and hollow microspheres thereto at any time, a sensitivity ranging from Boosterinitiation to No. 6 cap can be obtained. It has been well known that the w/o type emulsion explosives have excellent waterproofness and safety, which have never been given in the conventional explosives, because they contain an oily substance as continuous phase and aqueous oxidizer solution as discontinuous phase.

However, since the essential feature of emulsification is to bring one of the two mutually-insoluble solutions into minute particles and to disperse the thus obtained minute particles into the other solution uniformly by an emulsifier, a shortage of being poor in stability has been observed in the w/o type emulsion explosive according to the inventions of the U.S. Patents. Namely, the w/o type emulsion explosives have the desired sensitivity and explosive power just after the production thereof, however, as the time passes by, the discontinuous phase which has been dispersed at first becomes aggregated and very large in particle size resulting in the breakdown of the emulsion, and accordingly, there has been observed a problem in storage that the initial sensitivity and explosive power has been lost within a few months. In the case where the period from the production of the explosive to the use thereof is very short such as a few hours to a few days as in the so-called site mixing method or in the case where the explosive is used in a similar way to the former, the problem in storage is not so large, whereas, in the case where the period from the production of the explosive to the use thereof is from 6 months to about one year, the problem in storage that the initial sensitivity and explosive power is lost becomes a severe problem.

Accordingly, studies for improving a w/o type emulsion explosive to be better stability after storaging for a long period have been carried out, and as a result, an invention of improving the stability in storage of a w/o type emulsion explosive has been completed as in U.S. Pat. No. 4,386,977.

As a result of the present inventors' further studies for improving the stability of w/o type emulsion explosives in storage, it has been found by the present inventors that in the w/o type emulsion explosives according to the conventional inventions, the emulsion thereof become to be broken as time goes by, and the sensitivity thereof is reduced, and particularly, that even in the stable w/o type emulsion explosive disclosed in U.S. Pat. No. 4,386,977, the air-gap sensitivity of the explosive becomes reduced as time goes by, while the detonation velocity and the cap sensitivity are not reduced. In the cases where the explosives are actually used, there is almost no chance of using only one package of the explosive and usually, a few packages or, according to circumstances, ten and a few packages of the explosive are arranged parallel in a hole and fired simultaneously. In such cases, the deterioration of the air-gap sensitivity of the explosive as time goes by, causes a large problem.

As a result of the present inventors' studies and experiments for improving the shortage of the w/o type emulsion explosives, particularly the deterioration of air-gap sensitivity of the explosive as time goes by, it has been found by the present inventors that the use of a mixture of the oil component and at least one polymer selected from the group consisting of epoxy resin, unsaturated polyester resin, polybutene, polyisobutylene, petroleum resin, butadiene resin and ethylene vinyl acetate copolymer as the oily material of the continuous phase of the w/o type emulsion explosive remarkably reduces the degree of deterioration of the air-gap sensitivity of the explosive and also prevents the deterioration of the cap-initiation sensitivity and the explosion velocity.

SUMMARY OF THE INVENTION

There is an aspect of the present invention, there is provided a water-in-oil type emulsion explosive containing an aqueous oxidizer solution, an oily material, an emulsifier and hollow microspheres, wherein said oily material which forms the continuous phase of said emulsion comprises a mixture of an oil component and at least one polymer selected from the group consisting of epoxy resin, unsaturated polyester resin, polybutene, polyisobutylene, petroleum resin, butadiene resin and ethylene vinyl acetate copolymer

DETAILED DESCRIPTION OF THE INVENTION

As the continuous phase of the w/o type emulsion explosive according to the present invention, a mixture of at least one selected from the group consisting of mineral oil, vegetable oil, animal oil, fuel oil, kerosene, liquid paraffin, paraffin-wax, microwax and petrolatum and at least one polymer selected from the group consisting of epoxy resin, unsaturated polyester resin, polybutene, polyisobutylene, petroleum resin, butadiene resin and ethylene vinyl acetate copolymer is used. The content of the polymer in the mixture of the polymer and the above-mentioned oil-component may be in a broad range, however, the effectiveness of the polymer is remarkably exhibited in the case wherein the content thereof is in the range of 1 to 70% by weight.

The epoxy resin used according to the present invention is a resin having more than two of epoxy group represented by the formula,

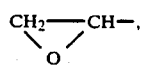

in one molecule thereof, and it may be preferably the product obtained by bringing generally commercialized epichlorohydrine into reaction with bisphenol A, and those of a molecular weight of 300 to 800 is more preferable.

The unsaturated polyester resin used according to the present invention consists essentially of a resin prepared by mixing (1) a chain polyester (also called as an unsaturated polyester) formed by polycondensing an unsaturated dicarboxylic acid such as fumaric acid and maleic anhydride and a saturated dicarboxylic acid such as phthalic anhydride with a glycol with (2) a polymerizable monomer containing a group represented by $CH_2{=}C<$ such as ethylene.

The polybutene used according to the present invention is a polymer mainly formed of isobutylene and is represented by the following structural formula:

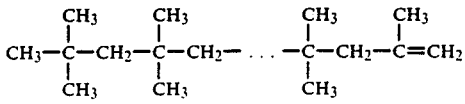

the molecular weight thereof being preferably 250 to 5,000.

The polyisobutylene is a polymer of highly pure isobutylene, and that of a molecular weight of 5,000 to 140,000 is preferable.

The petroleum resin used according to the present invention is a resin obtained by polymerizing a fraction which is available in the naphtha-cracking process, and the $C_5$-petroleum resins obtained by polymerizing $C_5$-fraction, the $C_9$-petroleum resins obtained by polymerizing $C_9$-fraction and $C_5$.$C_9$-petroleum resins obtained by copolymerizing $C_5$-fraction and $C_9$-fraction, having a molecular weight of 600 to 2,500 are preferable and those of a molecular weight of 1,000 to 1,400 are more preferable.

The butadiene resin used according to the present invention is a polymer obtained by polymerizing a monomer comprising butadiene [$CH_2{=}CH{-}CH{=}CH_2$] while leaving one carbon-carbon double bond within the 1,2-bonding position and/or 1,4-bonding position thereof. Of the thus obtained polybutadienes those having —H, —COOH or —$CH_2$—$CH_2$—OH as the chain-end thereof and having a molecular weight of 500 to 200,000 are preferable.

The copolymer of ethylene and vinyl acetate used according to the present invention is the product of copolymerization of ethylene [$CH_2{=}CH_2$] and vinyl acetate [$CH_3COOCH{=}CH_2$], and the copolymer of a melt index of 2 to 500 and of a content of vinyl acetate units of 5 to 50% by weight is preferable.

The oil component used according to the present invention is preferably a petroleum wax containing more than 30% by weight of a component which does not form an adduct with urea (refer to "SEKIYU KAGAKU ("Petroleum chemistry")", pages 534 to 538, edited by AMEMIYA, Tozo).

In the case where the petroleum wax containing more than 30% by weight of the component which does not form an adduct with urea (determined by AMEMIYA's method for analysis of the component which is contained in petroleum and does not form any adduct with urea, loc. cit.) is used as the oil component together with the above-mentioned resin in the preparation of the w/o type emulsion explosive according to the present invention, the thus prepared w/o type emulsion explosive is stable and does not substantially show any deterioration of the air-gap sensitivity of the explosive for more than one year after the production thereof.

Moreover, in the case of using a petroleum wax which contains more than 30% by weight of the component which does not form an adduct with urea and shows a melting point of higher than 160° F. as the oil component together with the above-mentioned resin, it is able to obtain a w/o type emulsion explosive which is stable and does not substantially show any deterioration of the air-gap sensitivity of the explosive for more than two years after production.

Table 1 shows the melting point, the respective ratio of the component which does not form an adduct with urea and the ratio which forms an adduct with urea measured by the AMEMIYA's analytical method of the commercialized petroleum waxes.

TABLE 1

| Reference No. | Name of Wax | Name of Seller | Melting point (°F.) | Ratio of Component (%) Not forming adduct with urea | Forming adduct with urea |
|---|---|---|---|---|---|
| 1 | Paraffin wax 135 | Mobil Oil Co. | 135 | 0.9 | 99.1 |
| 2 | Mobil wax 2305 | Mobil Oil Co. | 181 | 67.5 | 32.5 |
| 3 | Mobil wax celease | Mobil Oil Co. | 180 | 52.3 | 47.7 |
| 4 | Microwax 180 | Mobil Oil Co. | 182 | 62.1 | 37.9 |
| 5 | Microwax 190Y | Mobil Oil Co. | 194 | 46.7 | 53.3 |
| 6 | Waxrex 602 | Mobil Oil Co. | 178 | 72.3 | 27.7 |
| 7 | Waxrex 140 | Mobil Oil Co. | 151 | 21.5 | 78.5 |
| 8 | Waxrex 155 | Mobil Oil Co. | 157 | 48.3 | 51.7 |
| 9 | 145° Paraffin | NIPPON SEKIYU | 146 | 1.8 | 98.2 |
| 10 | NISSEKI-Micro Wax 155 | NIPPON SEKIYU | 158 | 39.7 | 60.7 |
| 11 | NISSEKI-Micro Wax 180 | NIPPON SEKIYU | 184 | 50.7 | 49.3 |
| 12 | SP 3040 | NIPPON SEIRO | 145 | 2.9 | 97.1 |
| 13 | Hi-Mic 1045 | NIPPON SEIRO | 152 | 84.5 | 15.5 |
| 14 | Hi-Mic 1070 | NIPPON SEIRO | 172 | 66.5 | 33.5 |
| 15 | Hi-Mic 1080 | NIPPON SEIRO | 183 | 42.8 | 57.2 |
| 16 | Hi-Mic 2045 | NIPPON SEIRO | 131 | 78.5 | 21.5 |
| 17 | Hi-Mic 2065 | NIPPON SEIRO | 167 | 28.9 | 71.1 |
| 18 | Hi-Mic 2095 | NIPPON SEIRO | 205 | 35.4 | 64.6 |
| 19 | Hi-Mic 3030 | NIPPON SEIRO | 182 | 54.8 | 45.2 |
| 20 | Hi-Mic 3065 | NIPPON SEIRO | 167 | 61.2 | 38.8 |
| 21 | Hi-Mic 3045 | NIPPON SEIRO | 148 | 74.8 | 25.2 |
| 22 | ESMAX 180 | Esso Standard Oil Co. | 180 | 79.2 | 20.8 |
| 23 | ESLUX 142 | Esso Standard Oil Co. | 146 | 22.8 | 77.2 |
| 24 | ESLUX 152 | Esso Standard Oil Co. | 153 | 42.1 | 57.9 |

TABLE 1-continued

| Reference No. | Name of Wax | Name of Seller | Melting point (°F.) | Ratio of Component (%) Not forming adduct with urea | Forming adduct with urea |
|---|---|---|---|---|---|
| 25 | ESLUX 172 | Esso Standard Oil Co. | 176 | 74.8 | 25.2 |

The content of oily material used according to the present invention is 1 to 10% of the weight of the w/o type emulsion explosive, preferably 2 to 8% thereof and it forms the continuous phase of the emulsion.

The aqueous oxidizer solution used according to the present invention is obtained by dissolving at least one salt selected from the group consisting of ammonium nitrate, an alkali metal nitrate, an alkaline earth metal nitrate, an alkali metal chlorate, an alkaline earth metal chlorate, an alkali metal perchlorate, an alkaline earth metal perchlorate and ammonium perchlorate in water. In addition, to the thus prepared aqueous oxidizer solution, a water-soluble amine nitrate such as monomethylamine nitrate, monoethylamine nitrate, hydrazine nitrate and dimethylamine dinitrate, a water-soluble alkanolamine nitrate such as methanolamine nitrate and ethanolamine nitrate and/or water-soluble ethylene glycol mononitrate may be added as the auxiliary sensitizer.

The content of water in the aqueous oxidizer solution is preferably such that the crystallization temperature of the aqueous solution is in a range of 30° to 90° C., and ordinarily is in the range of 5 to 40% by weight of the aqueous solution, and preferably in the range of 7 to 30% by weight. In order to reduce the crystalization temperature, a water-soluble organic solvent such as methanol, ethanol, formamide, ethylene glycol and glycerol may be added as an auxiliary solvent to water. In the present invention, the amount of the aqueous solution of the oxidant is 50 to 95% by weight of the total amount of the w/o type emulsion explosive.

The emulsifier used in the present invention is the emulsifier used ordinarily for formation of a w/o type emulsion, for instance, an alkali metal stearate, ammonium stearate, calcium stearate, polyoxyethylene ether and sorbitan ester of a fatty acid. Of those emulsifiers, an organic surfactant wherein an unsaturated long-chain aliphatic acid containing 10 to 24 carbon atoms constitutes the hydrophobic group is preferably used. The amount of the emulsifier of the present invention may be 0.5 to 7% by weight of the total amount of the w/o type emulsion explosive. In the case of using the emulsifier in an amount of 2.5 to 7% by weight, the thus formed w/o type emulsion explosive is more stable.

By adding suitable hollow microspheres into the composition of the w/o type emulsion explosive, a w/o type emulsion explosive showing an initiating sensitivity in a broad range from cap initiation to Booster initiation is obtained. As the hollow microspheres, at least one of the following substances is used: those made of glass, those made of a resin, silastic baloons and pearlite, in an amount such that the hollow microspheres make the specific gravity of the product (a w/o type emulsion explosive) less than 1.40 g/ml, preferably less than 1.30 g/ml. Although the amount of the hollow microspheres added to the composition depends on the specific gravity of the particle, etc., it is ordinarily in a range of 0.5 to 20% by weight of the product. An explosive substance such as TNT, penthrite and the like may be used together with the hollow microspheres in preparing the w/o type emulsion explosive according to the present invention.

In addition, it may be possible to make the w/o type emulsion explosive hold suitable gas bubbles therein, thereby substituting a part of the role of the hollow microspheres by the thus introduced bubbles.

To the w/o type emulsion explosive according to the present invention, metal powder such as pulverized aluminum, pulverized magnesium and the like and powdery organic material such as wood powder, starch and the like may be added.

The present invention will be explained more in detail while referring to the following non-limitative examples:

EXAMPLE 1

In a molten mixture of 5.6 parts by weight of No. 2 fuel oil and 2.4 parts by weight of EPICOAT ® 828 (an epoxy resin of a molecular weight of 400, made by Shell Oil Co.) prepared by heating the same mixture at 90° C., an aqueous oxidizer solution preliminarily prepared by dissolving 65 parts by weight of ammonium nitrate and 4 parts by weight of sodium chlorate in 15 parts by weight of water at 90° C. and 2 parts by weight of calcium stearate as an emulsifier were added and stirred, thereby a w/o type emulsion was obtained. After adding 6 parts by weight of pearlite to the thus obtained w/o type emulsion, the mixture was stirred to obtain a w/o type emulsion explosive.

COMPARATIVE EXAMPLE 1

Into 8 parts by weight of No. 2 fuel oil kept at 90° C. by heating, the respectively same amounts of the same aqueous oxidizer solution and the same amount of the same emulsifier were added as in Example 1, thereby a w/o type emulsion was obtained. By adding 6 parts by weight of pearlite to the thus obtained emulsion and stirring the mixture, a w/o type emulsion explosive was obtained.

EXAMPLE 2

By heating 2.4 parts by weight of a paraffin wax of a melting point of 146° F. (145°PARAFFIN ®, made by NIPPON SEKIYU Co., Ltd.) together with 0.05 part by weight of an unsaturated polyester resin (KAYARESIN ®, made by NIPPON KAYAKU Co., Ltd.) at 90° C., and into the thus prepared mixture, an aqueous oxidizer solution preliminarily prepared by dissolving 50 parts by weight of ammonium nitrate and 20 parts by weight of calcium nitrate in 25 parts by weight of water and 0.55 parts by weight of polyglycerol linoleate ester as emulsifier were added and stirred, thereby a w/o type emulsion was obtained. Into the thus prepared w/o type emulsion, 2.0 parts by weight of glass bubbles (made by 3 M Co., under the name of B 15/250) were added, and by stirring the mixture, a w/o type emulsion explosive was obtained.

COMPARATIVE EXAMPLE 2

Into 2.45 parts by weight of 145°PARAFFIN preliminarily kept at 90° C. by heating thereof, the respectively same amounts of the same aqueous solution of the same oxidants, the same emulsifier and the same glass bubbles were added as in Example 2 in the same manner as in Example 2, thereby a w/o type emulsion explosive was obtained.

EXAMPLE 3

After dissolving 2.8 parts by weight of polybutene of a molecular weight of about 1,000 (POLYBUTENE 10N, made by NIPPON Oil and Fats Co., Ltd.) in 1.2 parts by weight of 145°PARAFFIN by heating a mixture thereof, an aqueous oxidizer solution preliminarily prepared by dissolving 39 parts by weight of ammonium nitrate, 20 parts by weight of monomethylamine nitrate and 10 parts by weight of ethylene glycol in 7 parts by weight of water at 90° C. and 6.8 parts by weight of polyglycerol linoleate ester as an emulsifier were added to the solution of polybutene in 145°PARAFFIN, thereby a w/o type emulsion was obtained. After adding 3.0 parts by weight of the glass bubbles (made by 3 M Co., B28/750) and 10.2 parts by weight of granular TNT (trinitrotoluene) to the thus prepared emulsion, a w/o type emulsion explosive was obtained.

COMPARATIVE EXAMPLE 3

Into 4.0 parts by weight of 145°PARAFFIN kept at 90° C. by heating, the respectively same amounts of the same aqueous oxidizer solution, the same emulsifier, the same glass bubbles and the same TNT as in Example 3 were added in the same manner as in Example 3 to obtain a w/o type emulsion explosive.

EXAMPLE 4

In a molten mixture of 2.8 parts by weight of WAXREX® 140 of a melting point of 151° F. (made by Mobil Oil Co.) and 1.2 parts by weight of polyisobutylene of a molecular weight of about 9,000 (VISTANEX LMMS®, made by Esso Chemical Co.) prepared by heating thereof at 90° C., an aqueous oxidizer solution preliminarily prepared by dissolving 63 parts by weight of ammonium nitrate, 7 parts by weight of sodium perchlorate and 5 parts by weight of formamide in 13 parts by weight of water by heating at 90° C. and 2 parts by weight of sorbitan mono-oleate were added under agitation, thereby a w/o type emulsion was obtained. By adding 6 parts by weight of glass bubbles (B28/750, made by 3 M Co.) to the thus obtained w/o type emulsion, a w/o type emulsion explosive was obtained.

COMPARATIVE EXAMPLE 4

Into 4 parts by weight of WAXREX 140 preliminarily molten by heating thereof at 90° C., the respectively same amounts of the same aqueous oxidizer solution, the same emulsifier and the same glass bubbles as in Example 4 were added as in Example 4, thereby a w/o type emulsion explosive was obtained.

EXAMPLE 5

To a molten mixture of 2.8 parts by weight of WAXREX 140 and 1.2 parts by weight of a $C_5$-petroleum resin of a molecular weight of about 1,200 (Hi-rez® C-110X, made by MITSUI Petrochem. Co., Ltd.) at 90° C., an aqueous oxidizer solution prepared by dissolving 59 parts by weight of ammonium nitrate, 7 parts by weight of sodium perchlorate and 5 parts by weight of formamide in 13 parts by weight of water at 90° C. and 5 parts by weight of sorbitan mono-oleate as an emulsifier were added and stirred to obtain a w/o type emulsion. After adding 5 parts by weight of glass bubbles (B28/750, made by 3 M Co.) and 2 parts by weight of pearlite to the thus prepared w/o type emulsion, a w/o type emulsion explosive was obtained by stirring the mixture.

COMPARATIVE EXAMPLE 5

Into 4 parts by weight of WAXREX 140 preliminarily molten by heating thereof at 90° C., the respectively same amounts of the same aqueous oxidizer solution, the same emulsifier, the same glass bubbles and the same pearlite as in Example 5 in the same manner as in Example 5 were added, thereby a w/o type emulsion explosive was obtained.

EXAMPLE 6

Into a molten mixture of 2.8 parts by weight of ESLUX 172 of a melting point of 176° F. (made by Esso Standard Oil Co.) and 0.7 part by weight of a ethylene vinyl acetate copolymer of melt index of 300 containing about 28% by weight of vinyl acetate units (SUMITATE® KE-10, made by SUMITOMO Chem. Ind. Co., Ltd.) prepared by heating together the two substances at 90° C., an aqueous oxidizer solution prepared by dissolving 60 parts by weight of ammonium nitrate, 4.7 parts by weight of sodium perchlorate and 10 parts by weight of sodium nitrate in 14 parts by weight of water at 90° C., and 1 part by weight of sorbitan mono-oleate and 0.3 part by weight of polyglycerol linoleate ester as the emulsifier were added and stirred to obtain a w/o type emulsion, and after adding 6.5 parts by weight of glass bubbles (B 28/750, made by 3 M Co.) to the thus formed w/o type emulsion, the thus formed mixture was stirred well to obtain a w/o type emulsion explosive.

COMPARATIVE EXAMPLE 6

Into 3.5 parts by weight of ESLUX 172 molten at 90° C. by heating thereof, the respectively same amounts of the same aqueous oxidizer solution, the same emulsifier and the same glass bubbles as in Example 6 in the same manner as in Example 6 were added to obtain a w/o type emulsion explosive.

EXAMPLE 7

In a molten mixture of 2.8 parts by weight of ESLUX 172 and 0.7 part by weight of a butadiene resin of a molecular weight of about 100,000 and containing more than 90% by weight of the monomeric unit with a carbon-carbon double bond at its 1,2 bonding site and having H- at the chain end thereof (RB-810, made by NIPPON Synthetic Rubber Co.) at 90° C., an aqueous oxidizer solution prepared by dissolving 60 parts by weight of ammonium nitrate, 7 parts by weight of sodium nitrate and 3 parts by weight of sodium perchlorate in 14 parts by weight of water at 90° C. by heating thereof and 6 parts by weight of sorbitan mono-oleate as an emulsifier were added to obtain a w/o type emulsion. After adding 6.5 parts by weight of glass bubbles (B 28/757, made by 3 M Co.) to the thus obtained emulsion, the mixture was stirred, thereby a w/o type emulsion explosive was obtained.

COMPARATIVE EXAMPLE 7

Into 3.5 parts by weight of ESLUX 172 molten at 90° C. by heating, the respectively same amounts of the same aqueous oxidizer solution, the same emulsifier and the same glass bubbles as in Example 7 were added in the same manner as in Example 7 to obtain a w/o type emulsion explosive.

EXAMPLE 8

Into a molten mixture of 2.8 parts by weight of ESLUX 172 and 1.0 part by weight of a $C_5$-petroleum resin of a molecular weight of about 1,200 (Hi-rez 110 X, made by MITSUI Petrochem. Co.) at 90° C. prepared by heating thereof, an aqueous oxidizer solution prepared by dissolving 67 parts by weight of ammonium nitrate, 8 parts by weight of sodium nitrate in 12 parts by weight of water at 90° C., and 2.7 parts by weight of sorbitan mono-oleate were added and stirred to obtain a w/o type emulsion. Into the thus prepared w/o type emulsion, 6.1 parts by weight of glass bubbles (B 28/750, made by 3 M Co.) were added, thereby a w/o emulsion explosive was obtained.

The respective compositions of the w/o emulsion explosives prepared in Examples 1 to 8 and Comparative Examples 1 to 7 are shown in Table 2, and the initiation sensitivity, the explosion velocity and the air-gap sensitivity of the above-mentioned explosives measured during 2 years are shown in Table 3. As are seen in Table 3, the air-gap sensitivity of the explosives prepared in Comparative Examples showed a considerable deterioration with as time goes, however the degree of the deterioration was smaller in the explosives prepared in Examples 1 to 8. These differences show the effect of addition of the polymer according to the present invention.

TABLE 2

| | Examples | | | | | | | | Comparative Examples | | | | | | |
|---|---|---|---|---|---|---|---|---|---|---|---|---|---|---|---|
| Component | 1 | 2 | 3 | 4 | 5 | 6 | 7 | 8 | 1 | 2 | 3 | 4 | 5 | 6 | 7 |
| Epoxy resin | 2.4 | | | | | | | | | | | | | | |
| Unsaturated polyester resin | | 0.05 | | | | | | | | | | | | | |
| Polybutene | | | 2.8 | | | | | | | | | | | | |
| Polyisobutylene | | | | 1.2 | | | | | | | | | | | |
| Petroleum resin | | | | | 1.2 | | | 1.0 | | | | | | | |
| Ethylene vinyl acetate copolymer | | | | | | 0.7 | | | | | | | | | |
| Butadiene resin | | | | | | | 0.7 | | | | | | | | |
| No. 2 fuel oil | 5.6 | | | | | | | | 8 | | | | | | |
| 145° PARAFFIN | | 2.4 | 1.2 | | | | | | | 2.45 | 4 | | | | |
| WAXREX 140 | | | | 2.8 | 2.8 | | | | | | | 4 | 4 | | |
| ESLUX 172 | | | | | | 2.8 | 2.8 | 2.8 | | | | | | 3.5 | 3.5 |
| Water | 15 | 25 | 7 | 13 | 13 | 14 | 14 | 12 | 15 | 25 | 7 | 13 | 13 | 14 | 14 |
| Ammonium nitrate | 65 | 50 | 39 | 63 | 59 | 60 | 60 | 67 | 65 | 50 | 39 | 63 | 59 | 60 | 60 |
| Sodium nitrate | | | | | | 10 | 7 | 8 | | | | | | 10 | 7 |
| Calcium nitrate | | 20 | | | | | | | | 20 | | | | | |
| Sodium chlorate | 4 | | | | | | | | 4 | | | | | | |
| Sodium perchlorate | | | | 7 | 7 | 4.7 | 3 | | | | | 7 | 7 | 4.7 | 3 |
| Monomethylamine nitrate | | | 20 | | | | | | | | 20 | | | | |
| Formamide | | | | 5 | 5 | | | | | | | 5 | 5 | | |
| Ethylene glycol | | | 10 | | | | | | | | 10 | | | | |
| Sorbitan mono-oleate | | | | 2.0 | 5.0 | 1.0 | 6.0 | 2.7 | | | | 2.5 | 5 | 1.0 | 6.0 |
| Calcium stearate | 2 | | | | | | | | 2 | | | | | | |
| Polyglycerol linoleate ester | | 0.55 | 6.8 | | | 0.3 | | | | 0.55 | 6.8 | | | 0.3 | |
| Glass bubbles B15/250 | | 2 | | | | | | | | 2 | | | | | |
| Glass bubbles B28/750 | | | 3.0 | 6.0 | 5.0 | 6.5 | 6.5 | 6.1 | | | 3.0 | 6 | 5 | 6.5 | 6.5 |
| Pearlite | 6 | | | | 2.0 | | | | 6 | | | | 2 | | |
| TNT | | | 10.2 | | | | | | | | 10.2 | | | | |

TABLE 3

| | | Examples | | | | | | | |
|---|---|---|---|---|---|---|---|---|---|
| | | 1 | 2 | 3 | 4 | 5 | 6 | 7 | 8 |
| Specific Gravity | | 1.06 | 1.15 | 1.25 | 1.09 | 1.03 | 1.07 | 1.07 | 1.10 |
| Just after preparation | I.S. (*1) | p10g | No. 6 (*4) | p10g | No. 6 | No. 6 | No. 6 | No. 6 | No. 6 |
| | D.V. (*2) | 4580 | 4500 | 4970 | 4700 | 4520 | 4620 | 4570 | 4700 |
| | A.G.S. (*3) | 2.0 | 2.0 | 1.5 | 2.5 | 2.5 | 2.5 | 2.5 | 2.5 |
| 2 months after preparation | I.S. | p10g | No. 6 | p10g | No. 6 | No. 6 | No. 6 | No. 6 | No. 6 |
| | D.V. | 4410 | 4540 | 4890 | 4730 | 4550 | 4570 | 4520 | 4690 |
| | A.G.S. | 2.0 | 2.0 | 1.5 | 2.5 | 2.5 | 2.5 | 2.5 | 2.5 |
| 4 months after preparation | I.S. | p30g | No. 8 (*5) | p10g | No. 6 | No. 6 | No. 6 | No. 6 | No. 6 |
| | D.V. | 4490 | 4610 | 5020 | 4700 | 4550 | 4560 | 4610 | 4750 |
| | A.G.S. | 1.5 | 1.5 | 1.5 | 2.5 | 2.5 | 2.5 | 2.5 | 2.5 |
| 8 months after preparation | I.S. | Not measured | p5g | p10g | No. 6 | No. 6 | No.6 | No. 6 | No. 6 |
| | D.V. | | 4560 | 4870 | 4720 | 4480 | 4480 | 4710 | 4720 |
| | A.G.S. | | 1.5 | 1.5 | 2.5 | 2.5 | 2.5 | 2.5 | 2.5 |
| 12 months after preparation | I.S. | | p50g | p10g | No. 6 | No. 6 | No. 6 | No. 6 | No. 6 |
| | D.V. | | 4420 | 4980 | 4650 | 4610 | 4710 | 4480 | 4630 |
| | A.G.S. | | 1.0 | 1.5 | 2.5 | 2.5 | 2.5 | 2.5 | 2.5 |

TABLE 3-continued

| | | | | | | | | |
|---|---|---|---|---|---|---|---|---|
| 18 months after preparation | I.S. | Not measured | p100g | No. 6 | No. 6 | No. 6 | No. 6 | No. 6 |
| | D.V. | | 4670 | 4660 | 4620 | 4620 | 4510 | 4810 |
| | A.G.S. | | 1.0 | 2.0 | 2.5 | 2.5 | 2.5 | 2.5 |
| 24 months after preparation | I.S. | | Not measured | No. 6 | No. 6 | No. 6 | No. 6 | No. 6 |
| | D.V. | | | 4710 | 4480 | 4660 | 4620 | 4680 |
| | A.G.S. | | | 1.5 | 2.0 | 2.5 | 2.5 | 2.5 |
| 36 months after preparation | I.S. | | | No. 6 | No. 6 | No. 6 | No. 6 | No. 6 |
| | D.V. | | | 4690 | 4520 | 4710 | 4680 | 4720 |
| | A.G.S. | | | 1.5 | 2.0 | 2.0 | 2.5 | 2.5 |

| | | Comparative Examples | | | | | | |
|---|---|---|---|---|---|---|---|---|
| | | 1 | 2 | 3 | 4 | 5 | 6 | 7 |
| Specific Gravity | | 1.06 | 1.15 | 1.25 | 1.09 | 1.00 | 1.07 | 1.07 |
| Just after preparation | I.S. (*1) | p10g | No. 6 | p10g | No. 6 | No. 6 | No. 6 | No. 6 |
| | D.V. (*2) | 4710 | 4590 | 4920 | 4590 | 4520 | 4620 | 4710 |
| | A.G.S. (*3) | 2.0 | 2.0 | 1.5 | 2.5 | 2.5 | 2.5 | 2.5 |
| 2 months after preparation | I.S. | p10g | No. 6 | p10g | No. 6 | No. 6 | No. 6 | No. 6 |
| | D.V. | 4370 | 4580 | 4870 | 4610 | 4610 | 4710 | 4680 |
| | A.G.S. | 1.5 | 1.5 | 1.5 | 2.0 | 2.5 | 2.5 | 2.5 |
| 4 months after preparation | I.S. | p30g | No. 8 | p10g | No. 6 | No. 6 | No. 6 | No. 6 |
| | D.V. | 4410 | 4620 | 4980 | 4590 | 4610 | 4700 | 4580 |
| | A.G.S. | 0.5 | 1.0 | 1.0 | 1.5 | 2.0 | 2.0 | 2.5 |
| 8 months after preparation | I.S. | Not measured | p5g | p10g | No. 6 | No. 6 | No. 6 | No. 6 |
| | D.V. | | 4610 | 5100 | 4490 | 4630 | 4690 | 4490 |
| | A.G.S. | | 0.5 | 1.0 | 1.0 | 1.5 | 1.5 | 2.0 |
| 12 months after preparation | I.S. | | p50g | p10g | No. 6 | No. 6 | No. 6 | No. 6 |
| | D.V. | | 4560 | 5020 | 4620 | 4480 | 4580 | 4490 |
| | A.G.S | | 0 (*6) | 0.5 | 1.0 | 1.0 | 1.5 | 2.0 |
| 18 months after preparation | I.S. | | Not measured | p100g | No. 6 | No. 6 | No. 6 | No. 6 |
| | D.V. | | | 4710 | 4570 | 4510 | 4720 | 4530 |
| | A.G.S. | | | 0.5 | 0.5 | 1.0 | 1.0 | 1.5 |
| 24 months after preparation | I.S. | | | Not measured | No. 6 | No. 6 | No. 6 | No. 6 |
| | D.V. | | | | 4710 | 4500 | 4650 | 4570 |
| | A.G.S. | | | | 0.5 | 0.5 | 1.0 | 1.0 |
| 36 months after preparation | I.S. | | | | No. 6 | No. 6 | No. 6 | No. 6 |
| | D.V. | | | | 4600 | 4520 | 4640 | 4570 |
| | A.G.S. | | | | 0 (*6) | 0.5 | 0.5 | 1.0 |

Notes:
(*1) Initiation sensitivity (p means the weight of pentrite 50:50)
(*2) Detonation velocity (m/sec) measured by the method, of Doutriche in a JIS iron pipe.
(*3) Air-gap sensitivity of the sample explosives packed in a paper cartridge of 30 mm in diameter and placed on sand, the values showing the distance between the two cartridges by the number of multiplication of the diameter
(*4) No. 6 means the No. 6 cap.
(*5) No. 8 means the No. 8 cap.
(*6) under close contact

What is claimed is:

1. A water-in-oil type emulsion explosive containing
an aqueous oxidizer solution,
an oily material,
an emulsifier, and
hollow microspheres; wherein said oily material which forms a continuous phase of said emulsion comprises a mixture of an oil component and petroleum resin.

2. The water-in-oil type emulsion explosive of claim 1, comprising
50 to 95% by wt of the aqueous oxidizer solution,
1 to 10% by wt of the oily material,
0.5 to 7% by wt of the emulsifier and
0.5 to 20% by wt of hollow microspheres of said water-in-oil type emulsion explosive.

3. The water-in-oil type emulsion explosive of claim 1, wherein the molecular weight of said petroleum resin is 1,000 to 1,400.

4. The water-in-oil type emulsion explosive of claim 1, wherein the amount of said petroleum resin is 1 to 70% by weight of the amount of said oily material.

5. The water-in-oil type emulsion explosive of claim 1, wherein said oil component contains more than 30% by weight of a component which does not form an adduct with urea.

6. The water-in-oil type emulsion explosive of claim 1, wherein the amount of said emulsifier is 2.5 to 7% by weight of the total amount of said water-in-oil type emulsion explosive.

7. A water-in-oil type emulsion explosive containing:
50 to 95% by weight of an aqueous oxidizer solution,
1 to 10% by weight of an oily material,
2.5 to 7% by weight of sorbitan mono-oleate as an emulsifier, and
0.5 to 20% by weight of hollow glass microspheres; wherein said oily material which forms a continuous phase of said emulsion comprises a mixture of an oil component containing more than 30% by weight of a component which does not form an adduct with urea and a $C_5$-petroleum resin having a molecular weight of 1,000 to 1,400.

* * * * *